United States Patent [19]

Fleissner

[11] 3,997,291

[45] Dec. 14, 1976

[54] PROCESS FOR THE WET TREATMENT OF LENGTHS OF PRINTED TEXTILE MATERIAL IN SEVERAL TREATMENT BOWLS

[75] Inventor: Heinz Fleissner, Egelsbach near Frankfurt am Main, Germany

[73] Assignee: Vepa AG, Switzerland

[22] Filed: Nov. 19, 1973

[21] Appl. No.: 416,876

Related U.S. Application Data

[62] Division of Ser. No. 291,064, Sept. 21, 1972, abandoned.

[30] Foreign Application Priority Data

| | | |
|---|---|---|
| Sept. 21, 1971 | Germany | 2146990 |
| Nov. 16, 1971 | Germany | 2156765 |
| Feb. 14, 1972 | Germany | 2206872 |
| Feb. 21, 1972 | Germany | 2208053 |
| Mar. 24, 1972 | Germany | 2214267 |
| May 5, 1972 | Germany | 2222125 |

[52] U.S. Cl. ..... 8/137; 8/151; 8/151.2; 8/152; 68/178

[51] Int. Cl.[2] ..... D06B 3/24; D06B 5/08; D06L 1/08

[58] Field of Search ..... 8/137, 151.1, 151.2, 8/152, 151; 68/178

[56] References Cited

UNITED STATES PATENTS

| | | | |
|---|---|---|---|
| 2,602,723 | 7/1952 | Rogers | 8/152 |
| 3,409,919 | 11/1968 | Carpenter | 8/152 |
| 3,677,695 | 7/1972 | Peter | 8/152 |

FOREIGN PATENTS OR APPLICATIONS

| | | | |
|---|---|---|---|
| 1,277,549 | 10/1961 | France | 68/178 |
| 19,828 | 10/1956 | Germany | 68/178 |

*Primary Examiner*—Allen Lieberman
*Attorney, Agent, or Firm*—Craig & Antonelli

[57] ABSTRACT

A process for the washing of printed textile materials includes the steps of wetting a printed material with a treatment liquor, allowing the wetted printed material to dwell in a steeping bowl containing a treatment liquor for several minutes in a folded state with the material moving slowly through the steeping bowl and removing substances loosened by the steeping treatment from the printed material in an intensive flow-through washing stage by passing the printed material over a perforated surface of a perforated drum means within a washing bowl.

13 Claims, 10 Drawing Figures

PROCESS FOR THE WET TREATMENT OF LENGTHS OF PRINTED TEXTILE MATERIAL IN SEVERAL TREATMENT BOWLS

CROSS-REFERENCE TO RELATED APPLICATION

This application is a division of application Ser. No. 291,064 filed Sept. 21, 1972 and now abandoned.

The present invention relates to a process for the wet treatment of material lengths and in particular to a process wherein several treatment bowls are employed to wet the textile material; one of the bowls being designed as a high-efficiency wash bowl while the bowl preceding it serves as plain steeping bowl through which the material passes slowly and in folded state.

Perforated drum wash bowls excel due to the perfect washing effects that are achieved when using them in continuous operations and thus meet all requirements made on high-efficiency wash bowls. However, a good washing effect is not always sufficient, and especially if a prolonged dwell time is required to loosen the substances that are to be removed from the material. According to the invention it is therefore suggested to use a perforated drum bowl as high-efficiency wash bowl and to put another bowl which is well suited as steeping bowl in front of this high-efficiency wash bowl; it has been found that a J-box provides a particularly effective steeping bowl.

There are a large number of different designs of the J-box for washing, dyeing, bleaching, kiering and shrinking known. The material length which is to dwell in the liquor is always fed into the long leg of the J-box in the form of uniform folds and the material pile which is thus created is then pushed through the knee of the J-box due to its own weight.

The problems which arise when such a device is used are the material guidance, the reduction of the specific weight of the material which comes into being when the material length is submerged into the liquor and the uniform and tension-free delivery of the material which has to be safeguarded. It has long been deliberated how to eliminate any disturbance of the folds in the J-box and how to ensure at the same time the tension-free delivery of the material from the J-box. To this end, the delivery leg of the J-box was constructed in such a way that it widened out conically and was perforated so that the uniform penetration of the material length by the treatment liquor was guaranteed. To reduce the friction between the material to be treated and the J-box wall it is also known to install a roller conveyor on the bottom of the J-box. To this same end, it is also possible to let an endless conveyor pass through the J-box together with the material so that there is no relative motion between material and J-box wall at all.

However, all these attempts did not yield any positive result and it is therefore the aim of the present invention to provide for a process utilizing a device including a J-box or J-box means with which all the above problems are eliminated. To solve these problems there are quite a number of constructional characteristics of the J-box required some of which are already known; the device of this invention including a J-box is characterized in that:

a. The knee of the J-box is located in a bowl which is filled with the treatment liquor up to a certain level;

b. the walls of the J-box which are surrounded by the bowl and the clearance between which is constant, are liquid permeable;

c. the material length is wetted before being folded;

d. the material length is plaited into the long intake leg of the J-box in folds which completely fill the clearance between the two walls, and that until a certain height and consequently, a certain weight of the material pile has been achieved which ensures that e. the material pile is automatically pushed through the knee of the J-box and out above the liquor level in the delivery leg, and that up to a certain dripping height; and f. there is a drawoff roller installed immediately at the point of material delivery from the J-box.

As experiments have shown, a device having a J-box with the above-listed characteristics eliminates any disturbance of the material folds and at the same time ensures that the material length is guided from the delivery end of the J-box to the following machine absolutely tension-free. It is decisive for the perfect functioning of the J-box that the material length is wetted before plaited because this pre-wetting ensures not only the prolongation of the dwell time in the J-box but also the exact formation of folds in the intake leg. The further transport of the material through the J-box is safeguarded by the fact that it is pushed forth by its own weight. However, there is the danger of the material length being moved sideways when being drawn off; this danger is now eliminated because according to the invention, the material length is only drawn off on having left the liquor and after the liquor contained in it has been allowed to drip off for a predetermined period. When most of the entrained liquor has dripped off from the folded material, the material length is drawn off by means of a deflector roller which is mounted near the drawoff point and which is preferably designed as an expander roller, and is then guided to a pair of squeeze rollers which are most advantageously preceded by a spray pipe for applying fresh water to the material to be squeezed.

It is even more advantageous if the wetting assembly prior to the J-box serves not only for the plain pre-wetting by which the folding of the material into the J-box is to be facilitated, but is designed as a high-efficiency pre-rinsing assembly. To this end it is recommended to spray fresh water onto preferably both sides of the material length and to drain the loosened substances, e.g. the dyestuffs and thickening agents, immediately into the waste water channel.

The material is especially well pre-rinsed prior to the treatment proper if the spraying assembly comprises several deflector rollers which are followed by a squeezer unit e.g. a pair of squeeze rollers, and near which are spray pipes arranged from which fresh water is sprayed onto both sides of the material length. The squeeze rollers themselves should be sprayed over with fresh water to avoid that dyestuffs are deposited on them.

When the material has thus been freed from the most solid dirt particles, i.e. if it passes through and dwells in the J-box on having been pre-rinsed, the treatment in the J-box will not only ensure the loosening of the dirt on the surfaces of the material but also of the dirt contained within the material; consequently, all the dirt will have been attacked and loosened before the material is finally flown through by washing liquor and intensively washed on the perforated drum in the wash bowl.

An excellent cleaning effect is achieved if the liquor which has been squeezed off by the pair of squeeze rollers following the J-box and which certainly contains a large quantity of dirt, is directly drained into the waste water channel; to this end the overflow of the steeping bowl should be located between the J-box and the following squeezer unit and should be directly connected with the waste water channel.

Obviously, the spraying assembly at the intake end of the J-box should not only be suited for high-efficiency pre-rinsing but also serve as simple pre-wetting assembly, particularly if the material requires no pre-rinsing. Besides, it is suggested to equip a drain socket with a two-way valve through which concentrated washing liquor can be supplied into the liquor container of the assembly. This washing liquor will also wet the deflector roller or deflector rollers and is drained over an overflow.

According to the invention it may be a further very advantageous characteristic of the J-box that the steeping bowl in which the J-box is located is wider than the J-box and that the side walls of the J-box are liquid-permeable. If the fresh water supply connections are above the liquor level and preferably above the center point of the knee of the J-box, and if the liquor flows off to both sides and that essentially near the bend or knee of the J-box, the thus created streams of liquor along and parallel to the material folds smooth out the individual folds of the material to be treated.

In another very advantageous embodiment of the invention, the top wall of the J-box or at least the knee portion of the top wall is formed by guide rods which are aligned in the direction of the material passage therethrough and mounted at a certain distance from each other. This will enable the operator to watch the material pile which passes through the J-box and also, to influence material guidance by pushing folds that have possibly been caught forward by means of a stick or the like or by retarding the passage of the material.

The operator need not do anything at all if the top wall of the J-box performs a movement. This top wall could, for instance, swing slightly. It can also be of advantage to provide a drum with guide rods arranged on its surface in the knee of the J-box; this drum can also be a plain bar-drum which is driven or undriven, as required.

This provision alone, however, cannot ensure the tension-free drawing off of all types of material, i.e. also types of materials consisting of or containing shrinking fibers. Shrinking materials may well be uniformly plaited into the intake leg of the J-box and possibly caught material folds may well be pushed forth by means of a stick; the folds of shrunk materials will still be disturbed at the delivery end of the J-box because the distance between the J-box walls is now too wide for the material folds that have grown smaller. The J-box could, of course, have a conical shape but this would be disadvantageous for the treatment of other types of material.

According to the invention this problem does not arise if the top wall of the knee of the J-box is supported to be swivelable or pivotal around a hinge which is aligned parallel to the material width. The swivel or pivot point such as a hinge is to be located as required. It can, for instance, be situated in the delivery leg, above the liquor level. However, it is especially advantageous to arrange the hinge at the lower vertex of the upper wall of the J-box knee and thus let only the delivery end of the knee be swivelable. It is also feasible to design the delivery end of the top wall of the J-box to be translatorily shiftable or moveable. If and when the material shrinks, it is therefore possible to reduce the clearance between the walls of the delivery leg of the J-box in dependence on shrinkage values and thereby prevent the material pile from tilting sideways therein. The result of this is that the material length is always drawn off from above the liquor level and always from the top of the pile of material which has passed through the J-box.

It is also advantageous for the obtainment of a constant drawoff speed if the squeezer unit following the J-box according to the invention is preceded by a dancing roller which controls the speed of the takeup of the squeezer unit, e.g. the speed of the squeeze rollers.

The uniform plaiting of the material into the intake leg of the J-box is one of the pre-requisites for a uniform draw-off. The known plaiting funnel has been found to be unsuitable for this purpose. It will be of advantage if the plaiting assembly is designed as a plain beating unit or, especially with highly curling materials as a sloped metal sheet plate which extends parallel to the width of the material length falling down from a feed roller and which moves or swings to and fro. This metal sheet plate can be equipped with known expanding splines onto which liquor streams from spray nozzles are directed which serve for wetting the material and pressing it down onto the plate; the spray nozzles near the material selvedges preferably point slightly outward. It is also of advantage if the metal sheet plate is subdivided in lengthwise direction or if two such plates are provided so that dirty water can directly be drained through the gap which is thus produced between the two portions or two plates.

It has been found that not even with very delicate materials to be treated are there any folding marks produced if the material length passes through the J-box in the form of small waves or ripple-like folds. According to the invention it is recommended to let a pneumatic cylinder-piston unit act upon the metal sheet plate which unit moves the lower edge of the plate slowly to and fro across the width of the intake leg of the J-box; the material is thus plaited into the intake leg of the J-box in small waves which stand vertical to the larger material folds that extend from one wall of the J-box to the other.

Experiments were carried out on the device according to this invention which showed that, on condition that the material is fed into the J-box in the way suggested by the invention, the danger of staining or fold fixation is greatly reduced. Staining is eliminated because there are no large matting surfaces of material, and fold fixation, especially changing of the fiber structure at the bends, is avoided because the bends are subject to less weight or load than in the case of conventional machines. With the device according to the invention, the weight of the material pile is more uniformly distributed.

The above-described device can be used for washing any type of endless material and especially of cloth lengths. Most difficult to handle are printed textile materials that have to be freed from non-set dyestuffs and auxiliary agents on having been steam treated. Hitherto, this cleaning or washing has generally been done in discontinuously operating winch becks into which the material is plaited in broad folds and in which it is immersed for several hours.

With a view to the relatively long dwell times required for loosening the thickening agents, a continuous washing process for printed material lengths was hitherto considered impossible. It is true that there are diverse types of dwelling or steeping becks known, but it was not even tried to use such steeping becks for washing printed materials because the material has necessarily to be plaited and one could be certain that there would be a very grave staining, especially of white spaces in the material pattern. The stains produced in such a process could never be quite removed, not even by intensive washing. Besides, the fiber structure at the bends would certainly be changed while the material would be lying in the steeping beck in large folds.

According to the invention these dangers are eliminated if the printed material is first wetted or soaked and then plaited into a steeping bowl in which it dwells for several minutes before being intensively washed and freed from the previously loosened substances. As very thorough tests have shown, it is most advantageous to remove the dirt that was previously loosened in the steeping process by means of a liquor stream which is forced to flow right through the printed material length. After washing there were no undesired stains and no color bleeding marks observed which might have come into being especially with white pile materials. Consequently, it can be recognized that this process is a very successful one. With this process it is for the first time possible to wash printed materials, e.g. textiles such as woven cloth and the like, continuously. To this end, the material is first wetted and/or pre-rinsed, is then plaited and dwells in a calm liquor for 2 to 5, preferably 3, minutes and is finally intensively flown through by washing liquor in several washing steps, if necessary.

The succession in which the individual washing steps follow each other essentially depends on the types of dyestuffs used, especially, on the types of fibers of which the material consists. Textile materials of polyester fibers or blends with polyester fibers are dyed or printed by means of dispersion dyestuffs. These printed polyester cloths are first wetted, then squeezed and then plaited into the J-box; the squeezed-off liquor is drained. The material length thereupon dwells in the appropriate liquor for reductive cleaning in folded state. This process should not be carried out at high temperatures but preferably at 50°–60° C. because otherwise the texture might be destroyed. After this steeping treatment, the material is rinsed, acid-treated and again rinsed. All these washing steps are most advantageously performed on the flow-through method wherein sieves are used because this method ensures the complete removal of loosened thickeners or the like in the shortest possible time.

If the printed material at least partly consists of acrylic fibers or polyamide fibers, it is recommended to apply a certain volume of concentrated washing liquor to the cloth before folding it into the steeping bowl where it then dwells in this liquor for several minutes. The material is thereupon squeezed and finally rinsed several times at various temperatures and on the flow-through method.

Material lengths consisting of cotton and/or rayon staple fibers which are chiefly printed with reactive dyestuffs present most difficulties in washing. Similar to acrylic or polyamide materials, these cotton or rayon staple materials are first wetted with concentrated washing liquor and then plaited into the steeping bowl where they dwell for some minutes. On having been squeezed, the dirty water being directly drained, the material is rinsed on the flow-through method and again wetted with preferably hot washing liquor; it must then dwell for a second time in folded state, and that again for several minutes and is finally rinsed, acid-treated for some time and again rinsed. These washing or rinsing steps are preferably performed on the flow-through method.

Experiments have shown that the above described process can be intensified and consequently the washing effect improved by pre-rinsing the material with fresh water in a separate preliminary rinsing step; the fresh water used heretofore should come into contact with the material only once and then be immediately drained together with the dirt which is loosened and washed out of the cloth. This means that the material is not only wetted before being plaited into the steeping bowl, according to the invention this pre-wetting should above all facilitate plaiting, but that the material is already freed from the worst dirt at this initial rinsing stage. The contaminating substances, i.e. the thickening agents which are soaked with dyes, most often adhere to the material surfaces and can therefore be easily removed by intensive rinsing. It is recommended to drain the rinsing liquor carrying these substances, i.e. not to guide it into the steeping bowl, where it would foul the processing liquor and consequently, would cause an unnecessary re-contamination of the textile material.

To ensure that the printed material is actually well pre-cleaned at this preliminary rinsing stage, it is advisable to guide the pre-rinsed material length through a squeezer unit or a suction unit, e.g. a vacuum extractor and to drain the squeezed-off liquor. The intensive rinsing process can be repeated several times.

The final washing effect is even further improved if for the intensive washing processes following the pre-rinsing and steeping steps which are performed on the flow-through method, a large volume of fresh water is used, i.e. if there is more fresh water supplied into the perforated drum wash bowls than usually is employed.

The process of this invention will be further understood from the following detailed description and the accompanying drawings wherein.

Figure 2:
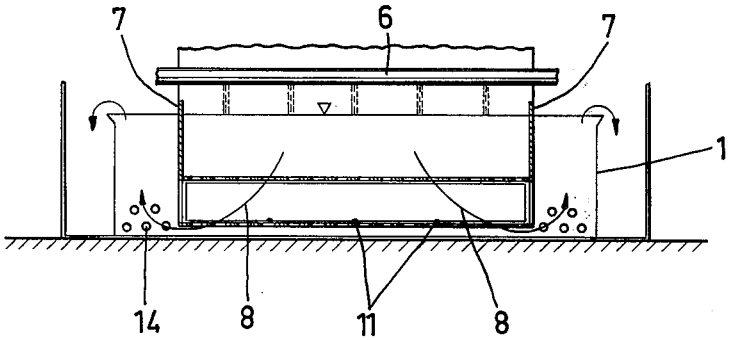
FIG. 2 is a section through the J-box along line II—II in FIG. 1.

A J-box 2 which is standing upright in a liquor container 1 has a preselected width, as may be gathered from FIG. 2, which ensures that a material length 4 of textile or the like can be exactly plaited into an intake leg 5 of the J-box by a plaiting unit 3, and that in openwidth. The walls of the intake leg 5 of the J-box 2 are made of compact metal sheet plates while those of the knee or curved portion of the J-box which is situated in the liquor in bowl 1 are perforated. Due to the fact that the walls of the knee are liquid-permeable, the permanent soaking of the material with the treatment liquor which is supplied into the bowl 1 through pipes 6, is safeguarded and ensured.

The J-box 2 is about as wide as the cloth length 4 which is to be plaited into it. The two side walls of the J-box are also liquid permeable while the inner surface of the knee is separated from the liquor containing bowl 1 at each side by a partition or wall 7. As may be gathered from FIG. 2 the bowl 1 is wider than the J-box so that the liquor which is supplied to the bowl through the pipe 6 can flow out of the J-box sideways in the direction of the arrows 8 and thereby smooth out the material folds. FIG. 2 also shows that the liquor is drained over an overflow.

To ensure the uniform plaiting of the material length, the material length must be wetted before passing through the plaiting unit 3. To this end, both sides of the material length are sprayed with liquor which is guided through spray pipes 9 and/or a bottom feed roller 10 runs in a liquor trough 9 from which it continuously takes up liquor and applies it to the material length 4. In addition, the top feed roller can of course be sprayed over with liquor.

On having passed through the J-box in invariably folded state which is safeguarded by parallel guide rods 11 which are welded onto the inside surface of the bottom wall of the J-box and are oriented in the direction of material passage and on having been pushed above the liquor level in the delivery leg of the J-box, the material length is drawn off by the pair of squeeze rollers 12. If the material length were drawn off from beneath the liquor level there would be the danger of the material folds being disturbed; besides, the material would still be soaked with liquor so that the tensionless drawoff would not be possible. For this reason, a drawoff roller 13 which is designed as an expander roller is most advantageously located immediately at the material drawoff point in the J-box. To ensure the better removal of loosened dirt particles there is a spray pipe 16 located in front of the squeezing unit 12 and extends across the width of the material.

Depending on the respective directions for treatment, the material length is processed in cold or in warm liquor. If the processing liquor is to be warm, it may be heated by means of steam, for example, which is guided through heating coils on the floor of the bowl 1. The liquor which has left the bowl over the overflow can be returned into the bowl through the pipes 6 or else, be guided to an attached trough 15 which extends across the width of the intake leg 5 of the J-box 2. The portion of the intake leg where this attached trough 15 is mounted is perforated to permit the liquor which is supplied into the trough in the direction of the arrows to flow through the walls of the intake leg into this leg so that the plaited material is pre-wetted with the processing liquor.

Figure 1:
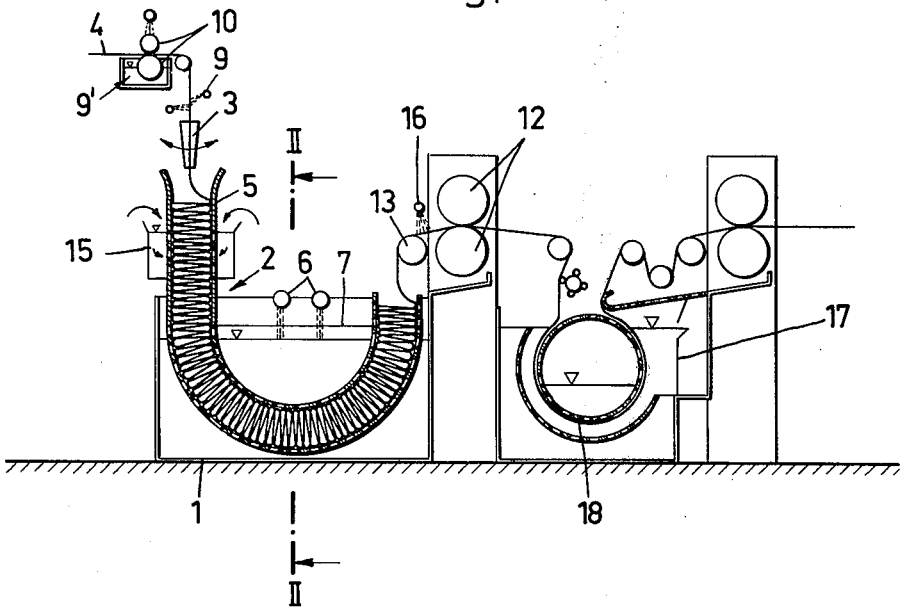
FIG. 1 is a section through a device for carrying out the process of the invention including a J-box and a subsequent perforated drum wash bowl.

From FIG. 1, it will be understood that the steeping bowl is followed by a perforated drum wash bowl which, as is generally known, comprises a perforated drum 18 which is rotated in a liquor container 17 and is flown through by the processing liquor due to the difference of liquor levels inside and outside the drum. This wash bowl guarantees the intensive washing of the material.

Figure 3:
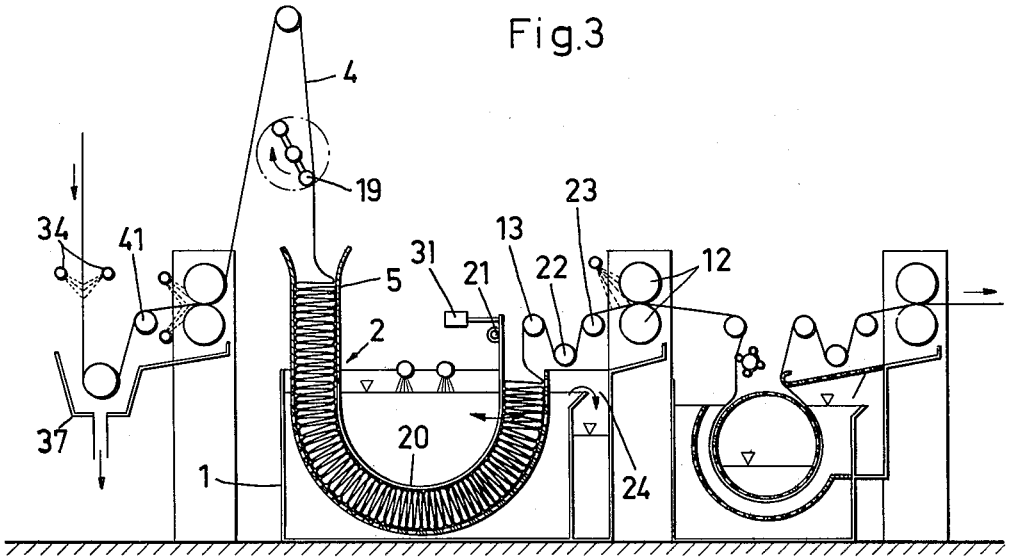
FIG. 3 shows the device according to FIG. 1, with modifications in its construction.
Figure 6:
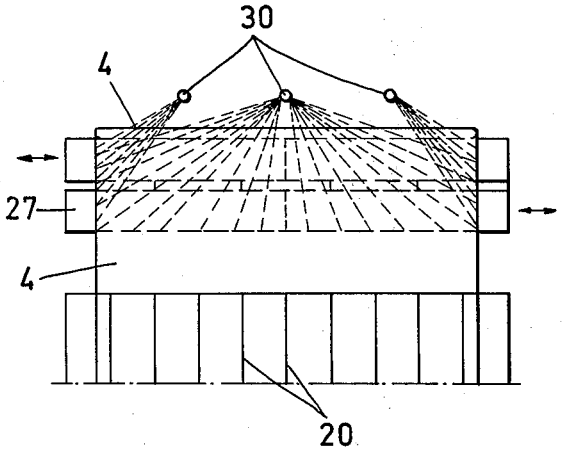
FIG. 6 is a top view of a detail of FIG. 5, seen in the direction of the arrow VI in FIG. 5.
Figure 5:
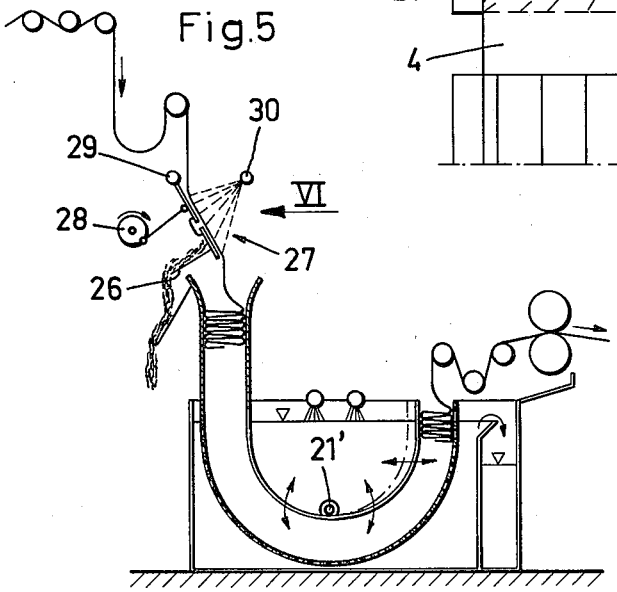
FIG. 5 shows still another embodiment of the J-box shown in FIG. 3.

FIG. 3 shows an embodiment wherein the material length is plaited into the steeping bowl 1, especially into the J-box 2 which is standing upright in this bowl by means of a plaiting unit which consists of a beating roller 19. The plaiting unit may also consist of another element, as is shown in FIGS. 5 and 6 and will described in detail. Just as shown in FIG. 1, the walls of the J-box shown in FIG. 3, and of these especially the top wall, are liquid permeable; as may be understood from FIG. 6. The top wall of the J-box in this embodiment consists of round rods 20 or the like which are aligned in the direction of the material passage and are fitted or spaced at a certain distance from each other. This design of the upper J-box wall permits the observation and, if necessary, the correction of the passage of the material pile through the J-box knee.

FIG. 3 and FIG. 5 show embodiments wherein the upper wall of the J-box, and of this only the bent knee portion, is pivoted around the hinge 21, and 21′, respectively. This permits changing and more specifically narrowing the cross section of the J-box channel. This is especially desirable if the material shrinks in the liquor and the uniform drawoff of the material length has to be safeguarded by a corresponding reduction of the cross section of the J-box channel. The movement of the J-box wall can be influenced by a counterweight 31.

The hinge 21 in FIG. 3 is located above the liquor level in the bowl, near the upper edge of the J-box wall. The hinge can also be arranged at or near the lower vertex of the knee, in the upper wall of the J-box. This design is shown in FIG. 5 where the hinge is marked 21′. It is of advantage if only the wall of the delivery section of the knee is swivelable. Of course, it is also possible to shift the delivery section of the upper J-box wall translatorily towards the outer or lower wall of the J-box (cf. arrows) to reduce the cross section of the knee.

Figure 4:
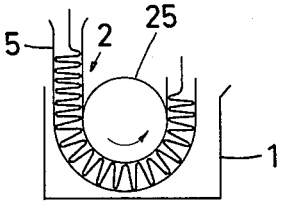
FIG. 4 shows another embodiment of the J-box, in reduced scale.

To ensure exact material guidance, the upper wall of the J-box knee can also be supported to move up and down. FIG. 4 shows still another embodiment. In this case the upper wall of the knee is designed as a perforated drum 25. This drum may either be positively driven or be caused to rotate by the friction between drum surface and material.

FIG. 3 shows an embodiment of the invention in which the pair of squeeze rollers 12 is not only preceded by the drawoff roller 13 near the liquor level but also by a dancing or vertically moveable roller 22 which controls the speed of the squeeze rollers 12 to ensure the maintenance of a constant minimum material tension. The squeeze rollers 12 should also be immediately preceded by an expander roller 23.

The liquor which is removed from the material 4 by the squeezer 12 is drained over an overflow 24 which is adjoined to the squeezing unit; consequently, the dirty squeezed-off liquor is not mixed with the processing liquor in the bowl 1 but is immediately guided into the waste water channel.

The previously mentioned plaiting unit consisting of a beating roller 19 should be used if the material 4 is fed into the J-box after having been thoroughly wetted in a trough 37 and by spraying units 34. However, if the material to be treated tends to curl at the selvedges (cf. FIG. 6) it should only be wetted shortly before being plaited into the J-box. In this case, the plaiting unit is most advantageously designed as a simple plate 27 which is shown in FIG. 5. This plate is caused to swing back and forth by an eccentric element 28. The swivel axis of the plate 27 is best located at its upper free end 29. It is further possible that the plate 27 performs a slight to-and-fro motion to ensure that the material is at the same time expanded.

A special design of the guide plate 27 is particularly advantageous. As is shown in FIG. 6, this plate is subdivided lengthwise and the two parts are set at a certain distance from each other. It is thus possible to let the water which is applied to the material through spray pipes 30 flow off through the gap between the plates and over an angle 26 into the drain channel without being mixed up with the treatment liquor in the J-box which is to be kept as clean as possible. As is shown in FIG. 6, the surface of the plate which comes into contact with the material should be provided with outward inclined splines so that the plaiting unit 27 at the same time serves as expanding unit.

Figure 7:
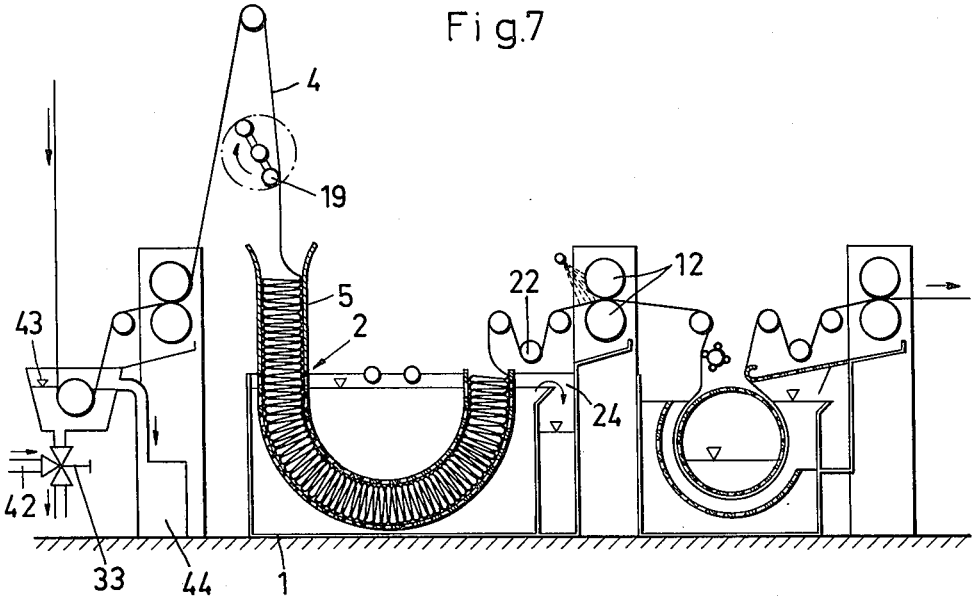
FIG. 7 shows the device according to FIG. 1, with further supplements to its construction.

According to FIG. 7, the J-box is also preceded by a rinsing unit 32 for pre-cleaning the material 4, which rinsing unit can possibly serve as plain wetting unit, and that due to the provision of a three-way valve 33.

Printed materials have usually to be freed from easily removable auxiliaries, e.g. surfactants, finishing agent and unset dyestuffs before dwelling in the J-box. This pre-cleaning is most easily effected by spraying fresh water onto the material, which fresh water is supplied through pipes 34. The dirty water which then flows off from the material length is drained into the waste water channel through a nozzle 35. Near the squeeze rollers which follow a deflector roller 36 in a container 37 there should also be spray pipes 39 installed to ensure the continuous cleaning of the squeeze rollers 38 which may have been contaminated.

Figure 8:
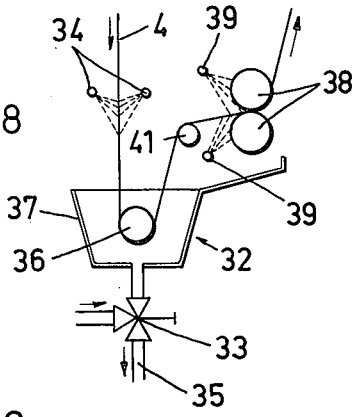
FIG. 8 shows the wetting unit at the intake end of the device, which unit has here another function.
Figure 9:
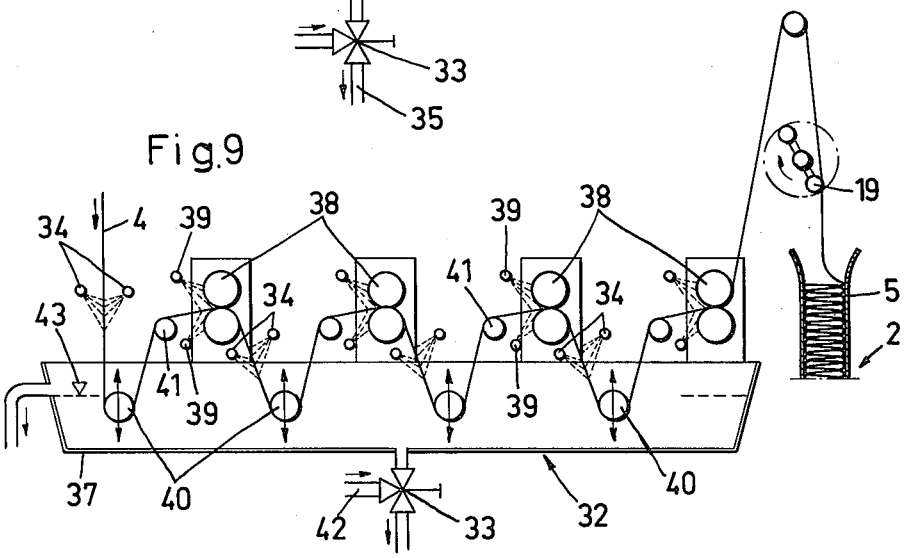
FIG. 9 shows a wetting unit which ensures the more efficient pre-cleaning of the material to be treated.

The efficiency of the unit shown in FIG. 8 can be multiplied by providing several of these units in tandem arrangement; this arrangement is shown in FIG. 9. In this case, the deflector roller at the same time serves as dancing roller 40 and controls the speed of the subsequent squeezer 38. Here, too, the squeezers should be preceded by an expander roller 41 each.

If the rinsing unit with the container 37 is not to be used for cleaning but only for wetting the material with a concentrated washing liquor, for instance, washing liquor 42 is supplied into the container 37 through the three-way valve 33 until a certain level 43 has been achieved; superfluous washing liquor flows off into a tank 44.

An excessive fouling of the processing liquor in the bowl 1 can also be avoided by an overflow over which the surplus liquor from the bowl and dirty water that has been squeezed off from the material 4 by the squeezing unit 12 is drained; this embodiment is shown in FIG. 7. To this end, the overflow is located between the squeezer rollers 12 and the bowl 1, approximately underneath the dancing roller 22 which controls the speed of the squeeze rollers 12.

Figure 10:
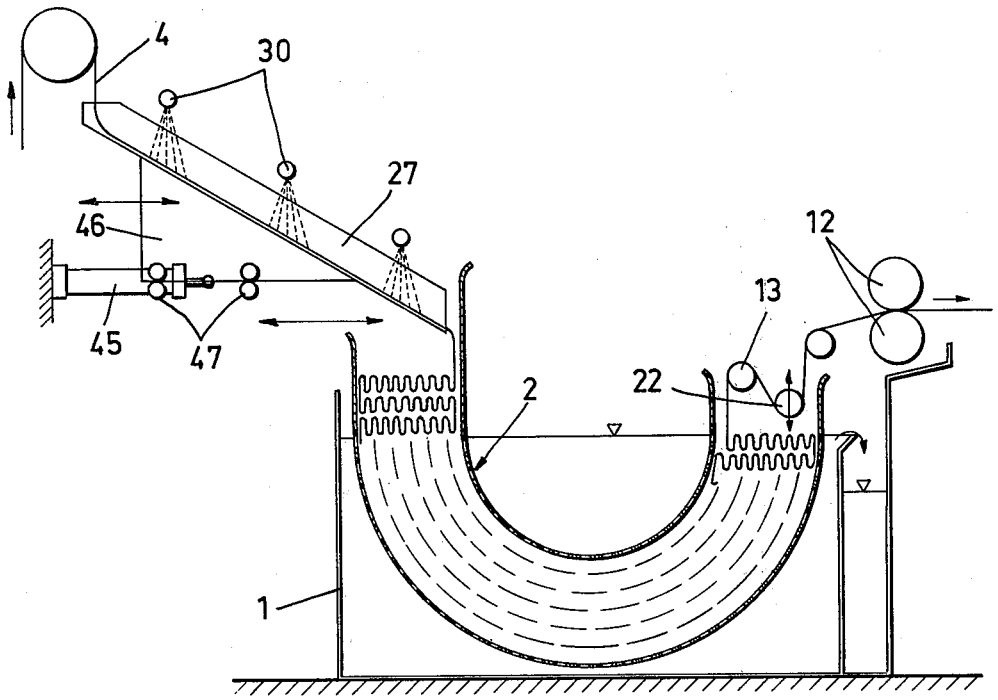
FIG. 10 shows a special embodiment of the J-box according to FIG. 5.

FIG. 10 shows further details of a J-box as shown in FIG. 5. In this case, the plaiting unit 27 is also designed as a guide plate which is sloping towards the intake end of the J-box and is aligned parallel to the material 4 which falls down from a feed roller.

The plate 27 can be moved to-and-fro horizontally in the direction of the arrows. This to-and-fro motion is caused by a piston-cylinder unit 45 which is fixed at one end and with the other, e.g. with the free end of the piston, acts upon a support 46 underneath the plaiting unit 27. The support and the plaiting unit 27 are easily movable on runners 47. Depending on the speed at which the plaiting unit 27 moves, the material length is folded in a certain way. FIG. 10 shows the type of folds that are produced when the unit moves slowly. In this case the J-box is completely filled with small material waves and with larger folds extending from one wall of the J-box to the other.

While the novel embodiments of the invention have been described, it will be understood that various omissions, modifications and changes in these embodiments may be made by one skilled in the art without departing from the spirit and scope of the invention.

What is claimed is:

1. A process for the washing of printed textile materials comprising woven or knitted fabrics of natural and/or synthetic fibers which comprises wetting a printed material with a treatment liquor; allowing the wetted printed material to dwell in a steeping bowl containing a treatment liquor for several minutes in a folded state, said steeping bowl comprising a J-box having a knee portion located in a bowl containing said treatment liquor up to a certain liquid level, an intake leg portion and a delivery leg portion, and said printed material being pushed slowly through the knee portion of said J-box in said folded state and out above the liquid level in the delivery leg portion whereby tension-free delivery of the printed material from the J-box is obtained, and removing substances, which have been loosened by the steeping treatment in said J-box, from the printed material in an intensive flow-through washing stage by conveying the printed material on a perforated surface of a perforated drum means within a perforated drum washing bowl means.

2. A process according to claim 1, wherein the substances that have been loosened in the steeping bowl are removed from the material by a rinsing liquor which flows through the printed material being conveyed on said perforated surface.

3. A process according to 1, wherein the printed material dwells in a calm liquor in said folded state within said J-box having a long intake leg portion and a short delivery leg portion.

4. A process according to claim 1, wherein the printed material is intensively penetrated by a washing liquor in several individual washing stages.

5. A process according to claim 1 for washing textile materials of polyester fibers or blends containing polyester fibers, which materials are chiefly printed with dispersion dyestuffs, wherein the printed polyester material is first wetted and squeezed and the squeezed-off liquor is drained, and the printed material thereupon dwells in said folded state within said steeping bowl in an appropriate liquor for reductive cleaning and is finally rinsed, acid-treated and rinsed again by a flow-through stage on said perforated surface.

6. A process according to claim 1 for washing printed materials which at least partly consist of acrylic or polyamide fibers, wherein the printed material is first wetted with a concentrated washing liquor in said steeping bowl and then dwells in this liquor in folded state before being squeezed and finally rinsed at different temperatures and in the flow-through stage.

7. A process according to claim 1 for washing materials of cotton or rayon staple fibers which are mainly printed with reactive dyestuffs, wherein the printed material is wetted with a concentrated washing liquor, then dwells in the treatment liquor in the folded state for several minutes, is then squeezed - the squeezed-off liquor being drained — and rinsed in the flow-through stage, is again wetted preferably with hot washing liquor, again dwells in the folded state, is again rinsed in the flow-through stage, is acid-treated for a certain time and that preferably also in the flow-througn stage, and is finally rinsed.

8. A process according to claim 1, wherein the printed material is wetted in a pre-rinsing stage, said pre-rinsing stage being effected by spraying the material intensively with fresh water and a rinsing liquor comes into contact with the material only once.

9. A process according to claim 8, wherein the material is squeezed or dehydrated by suction and the rinsing step is then repeated at least once.

10. A process according to claim 8, wherein the material comes into contact with large volumes of fresh water on having dwelled in said steeping bowl and in the subsequent washing steps which are performed in the flow-through stage.

11. A process according to claim 1, wherein said printed material is initially plaited into said folded state within said intake leg until a certain height of material is reached and a certain weight of material is achieved to cause said material to be pushed through said J-box.

12. A process according to claim 11, wherein said printed material is plaited into uniform small waves which stand vertical to larger material folds that extend from one wall of the J-box to the other.

13. A process according to claim 1, wherein said printed material is drawn from the steeping bowl above a liquid level therein by a drawoff roller, the printed material is squeezed between a pair of rollers and is passed to said intensive through-flow washing stage.

* * * * *